United States Patent [19]

Gold

[11] 4,102,614

[45] Jul. 25, 1978

[54] MACHINES FOR GENERATING MOTION

[76] Inventor: Bernard Gold, 54 Ashley La., Hendon London, England, NW4 1PL

[21] Appl. No.: 771,949

[22] Filed: Feb. 25, 1977

[30] Foreign Application Priority Data

Feb. 25, 1976 [GB] United Kingdom ..... 7458/76

[51] Int. Cl.[2] ..... F04C 1/02

[52] U.S. Cl. ..... 418/59; 418/60

[58] Field of Search ..... 418/58, 59, 60, 166, 418/192, 193, 196, 209, 215

[56] References Cited

U.S. PATENT DOCUMENTS

| | | | |
|---|---|---|---|
| 2,680,949 | 6/1954 | Butler | 418/196 X |
| 2,681,621 | 6/1954 | Hedman | 418/196 X |
| 3,804,563 | 4/1974 | Konshin et al. | 418/58 X |

FOREIGN PATENT DOCUMENTS

| | | | |
|---|---|---|---|
| 2,288,231 | 5/1976 | France | 418/196 |
| 213,586 | 5/1968 | U.S.S.R. | 418/58 |

*Primary Examiner*—Carlton R. Croyle
*Assistant Examiner*—Leonard Smith
*Attorney, Agent, or Firm*—Andrus, Sceales, Starke & Sawall

[57] ABSTRACT

A machine for generating motion is constructed like an epicyclic gear, with the intermediate gears mounted on a cylindrical core between the inner and outer gears. The intermediate gears are alternately axially offset and the core provides circumferential undulating guides for pistons that slide in the inner and outer gear teeth so that they pass over and under the intermediate gears. The pistons and intermediate gears divide the space between inner and outer gears into separate chambers to which pressure fluid can be selectively admitted to achieve rotation.

9 Claims, 17 Drawing Figures

MACHINES FOR GENERATING MOTION

This invention relates to machines for generating motion.

According to the present invention there is provided a machine for generating motion comprising a mutually rotatable co-axial assembly of an internally toothed outer member, a generally cylindrical intermediate core and an externally toothed inner member; an even number of circumferentially evenly spaced toothed gate elements rotationally carried by said core at alternately opposite axial ends, these gate elements meshing with said members; closure means at each axial end of said assembly to seal off the space between inner and outer members and each to sealingly co-operate with one end face of the respective one or group of said gate elements; two arrays of pistons respectively axially slidable along the teeth of the inner and outer members and which co-operate with the inner and outer faces of the core; guide means on said core faces determining paths for both arrays of pistons that direct them with a close sliding fit between the other end faces of the gate elements and the closure means remote therefrom, said space thus being divided by said pistons and said gate elements into double said number of similar mutually separate chambers of generally curved triangular shape; and means providing fluid passages to and from said chambers.

In the preferred form there are just two diametrically and axially opposed gate elements, and the outer member is fixed. The teeth in the inner and outer members may be formed by semi-circular recesses or they may be substantially semi-cylindrical lobes, the pistons and gate elements being shaped accordingly.

Conveniently, the guide means comprise tracks in the inner and outer faces of the core, the pistons each being provided with a projection, such as a ball bearing, that locates in the adjacent track.

The gate elements may be modified by the substitution, for part of their length, of offset gear elements which mesh with one of said members and which are shielded from the other by a baffle which is fixed to the core. The arrangement is such that there is gear pumping between circumferentially adjacent chambers.

Parts of the core will circumferentially divide each chamber into radially inner and outer sub-chambers, and preferably these parts are cutaway or reduced to allow free circulation of fluid between the sub-chambers.

The fluid passages are conveniently between the inner member and the end closure means.

Figure 1:
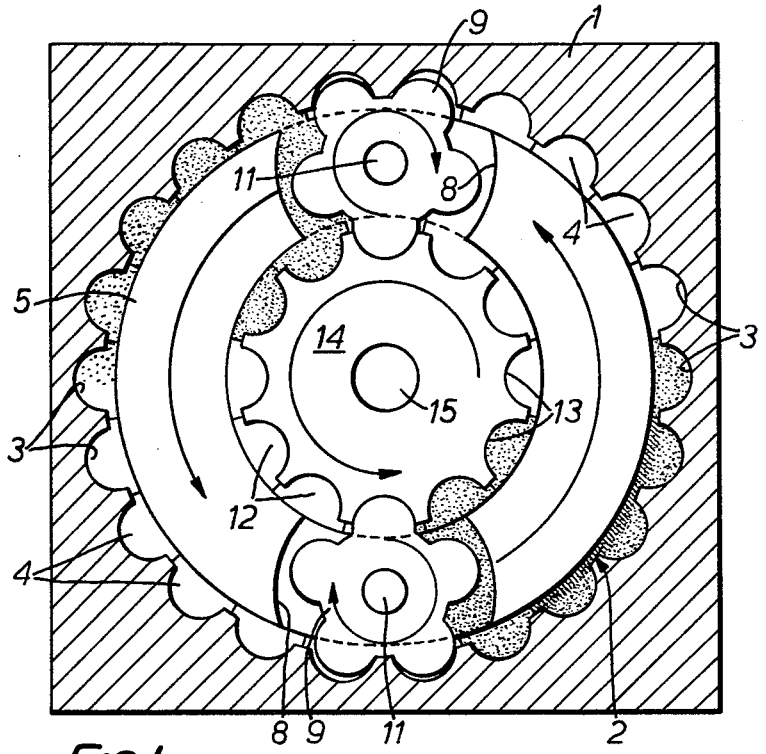
Figure 2:
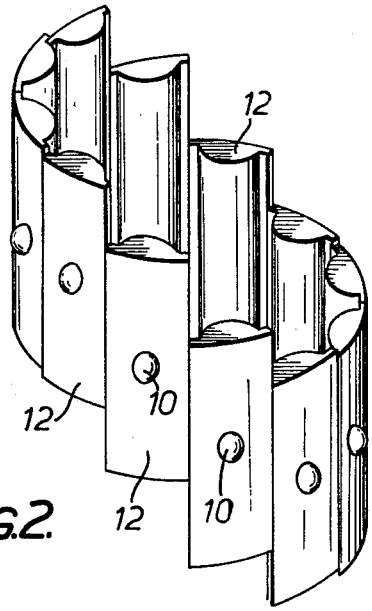
Figure 3:
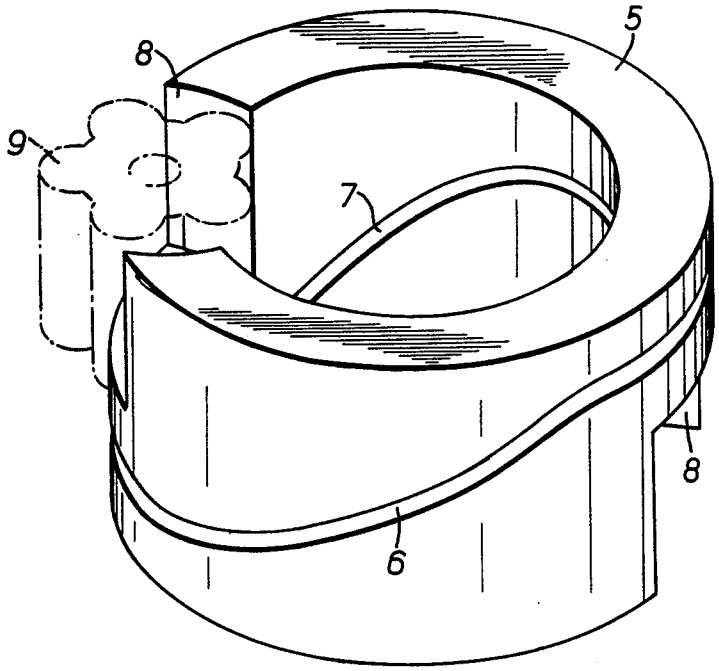
Figure 4:
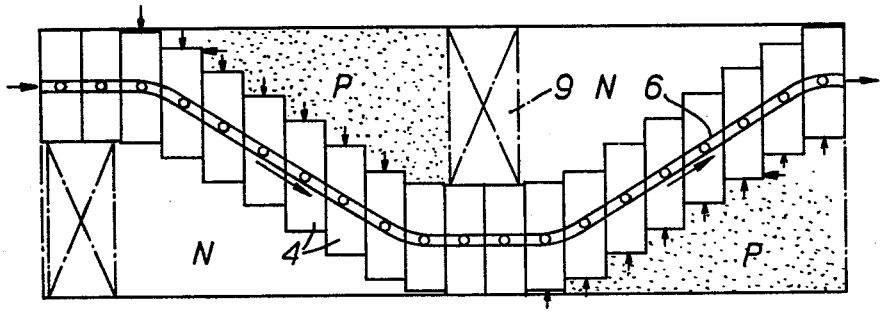
Figure 5:
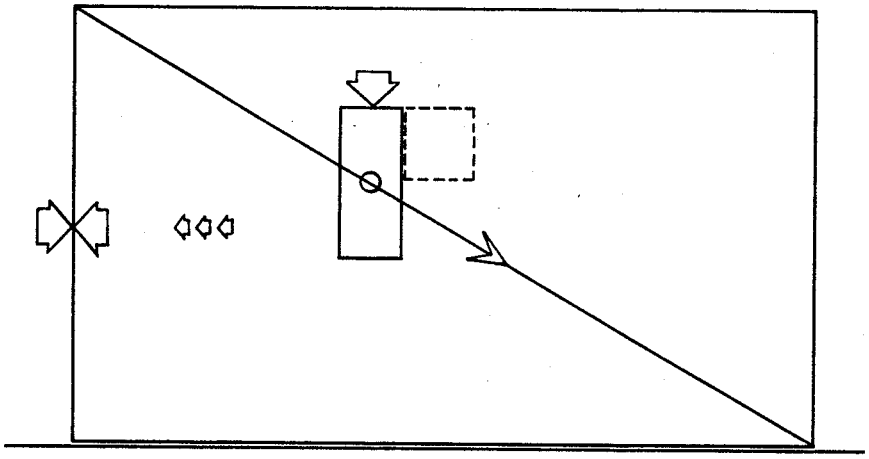
Figure 6:
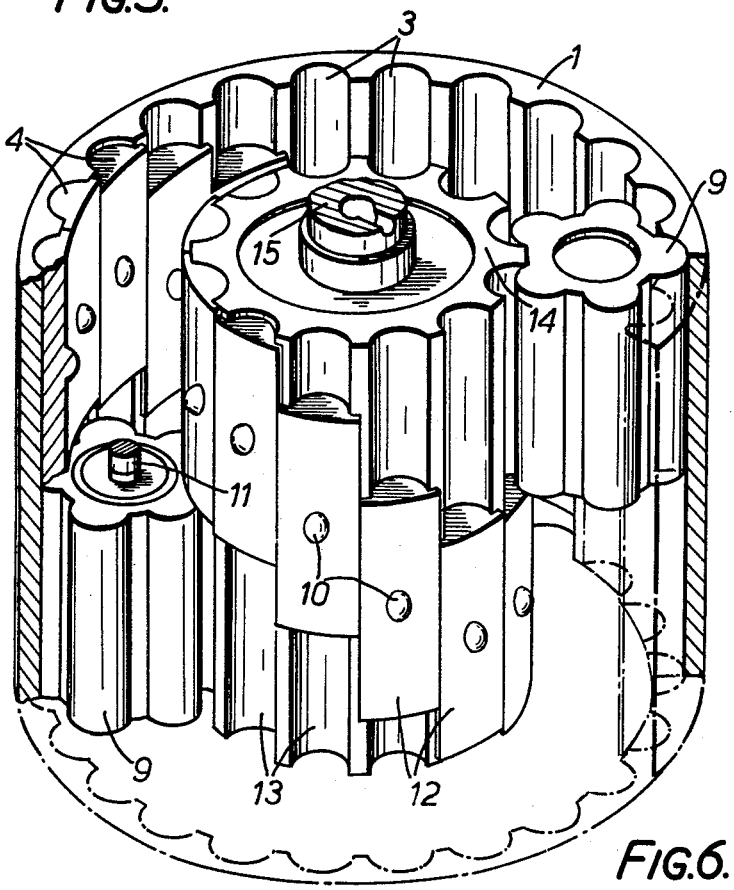
Figure 7:
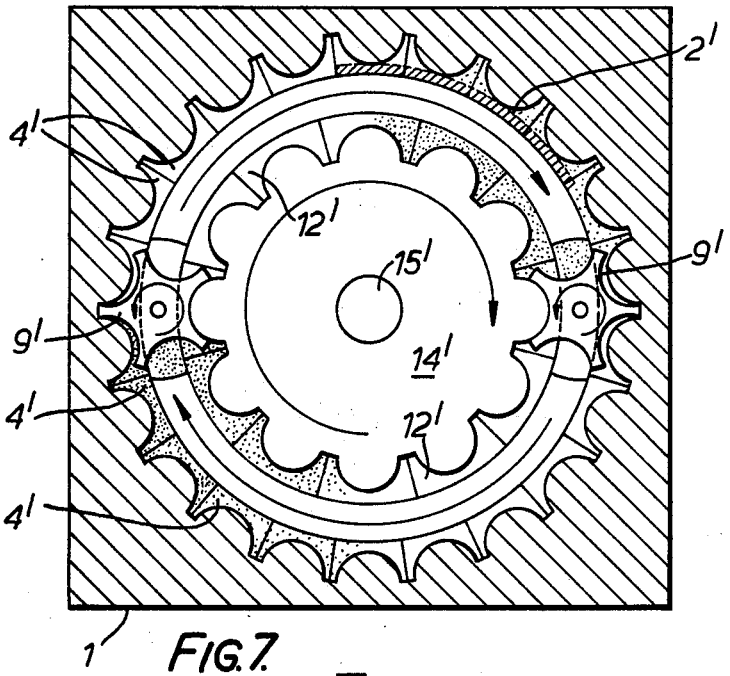
Figure 8:
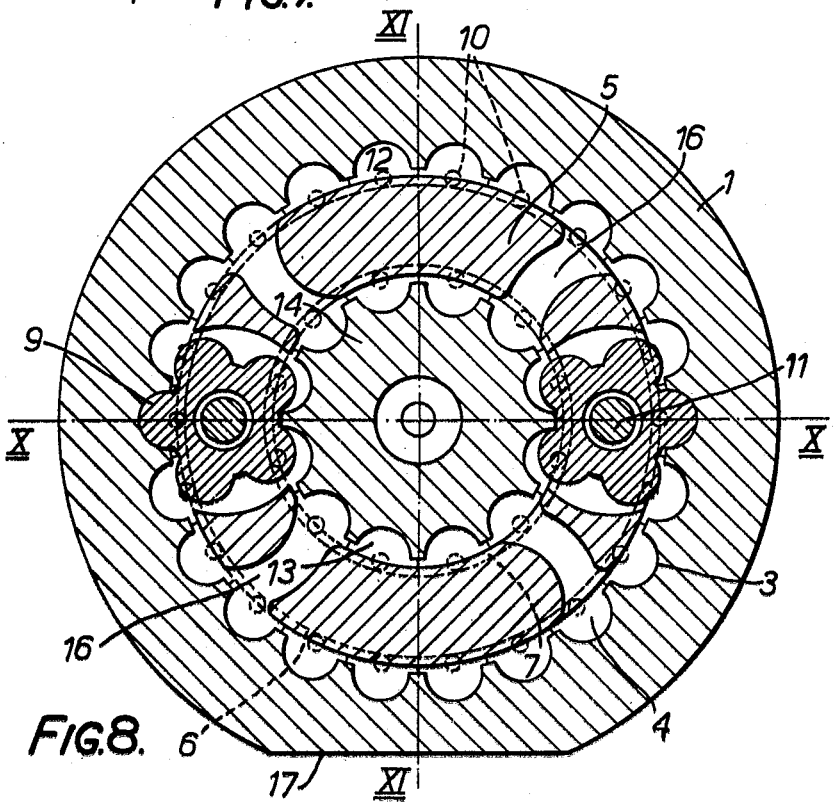
Figure 9:
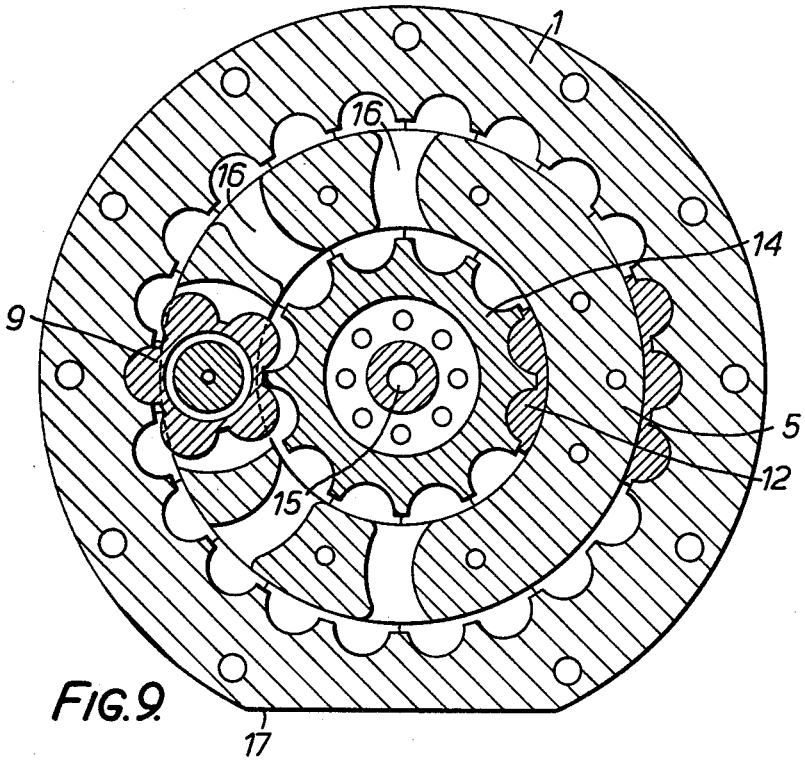
Figure 12A:
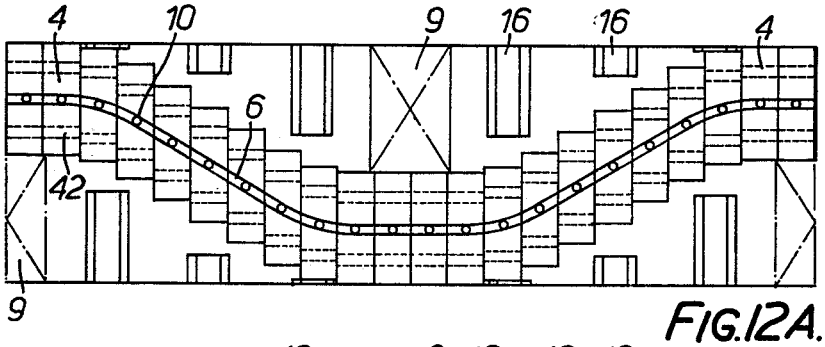
Figure 12B:
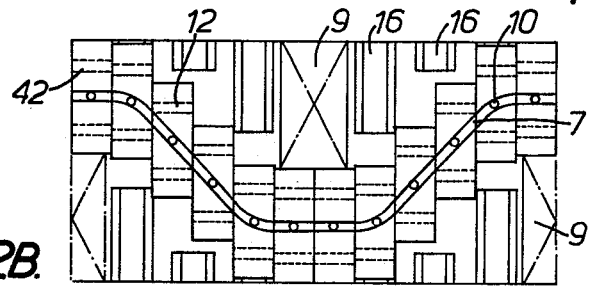
Figure 10:
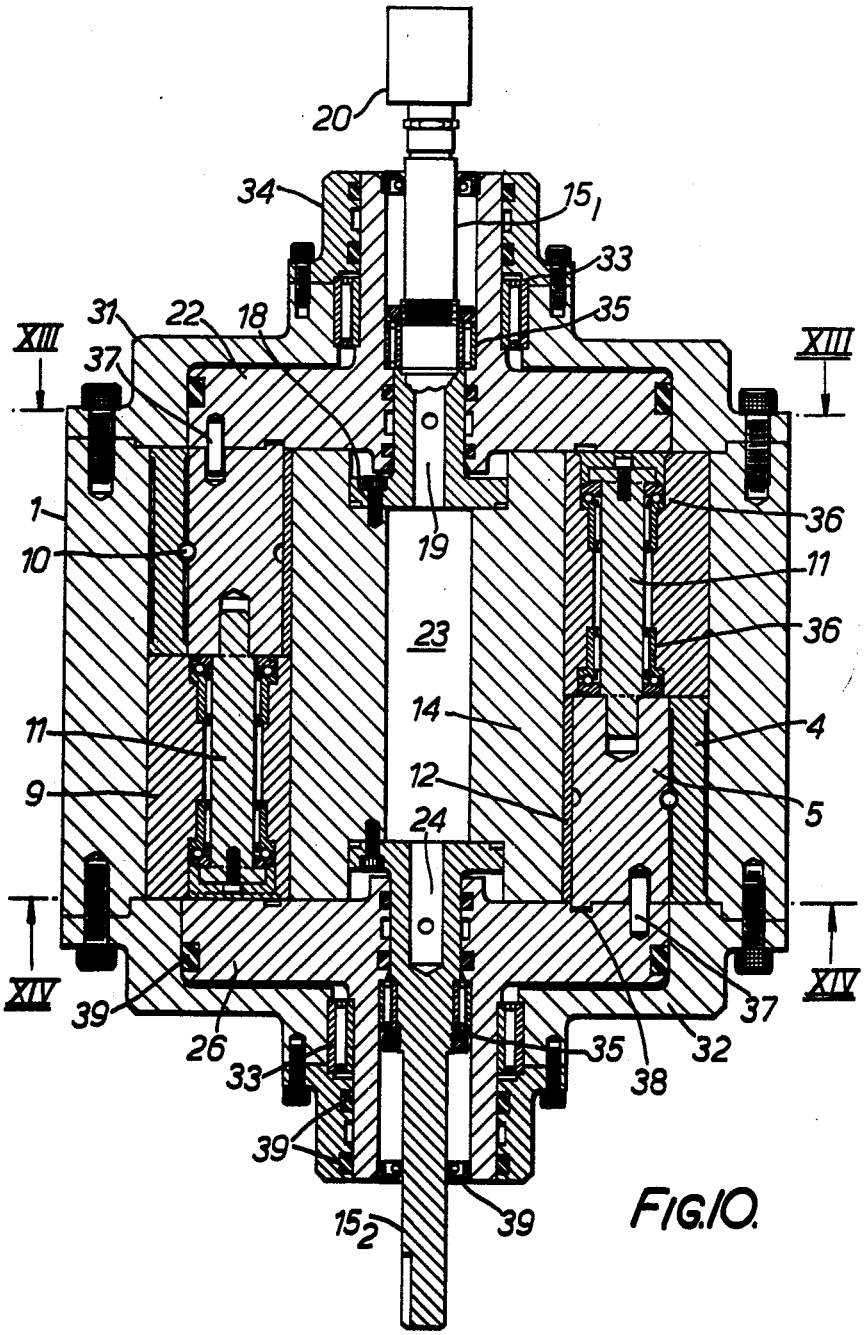
Figure 11:
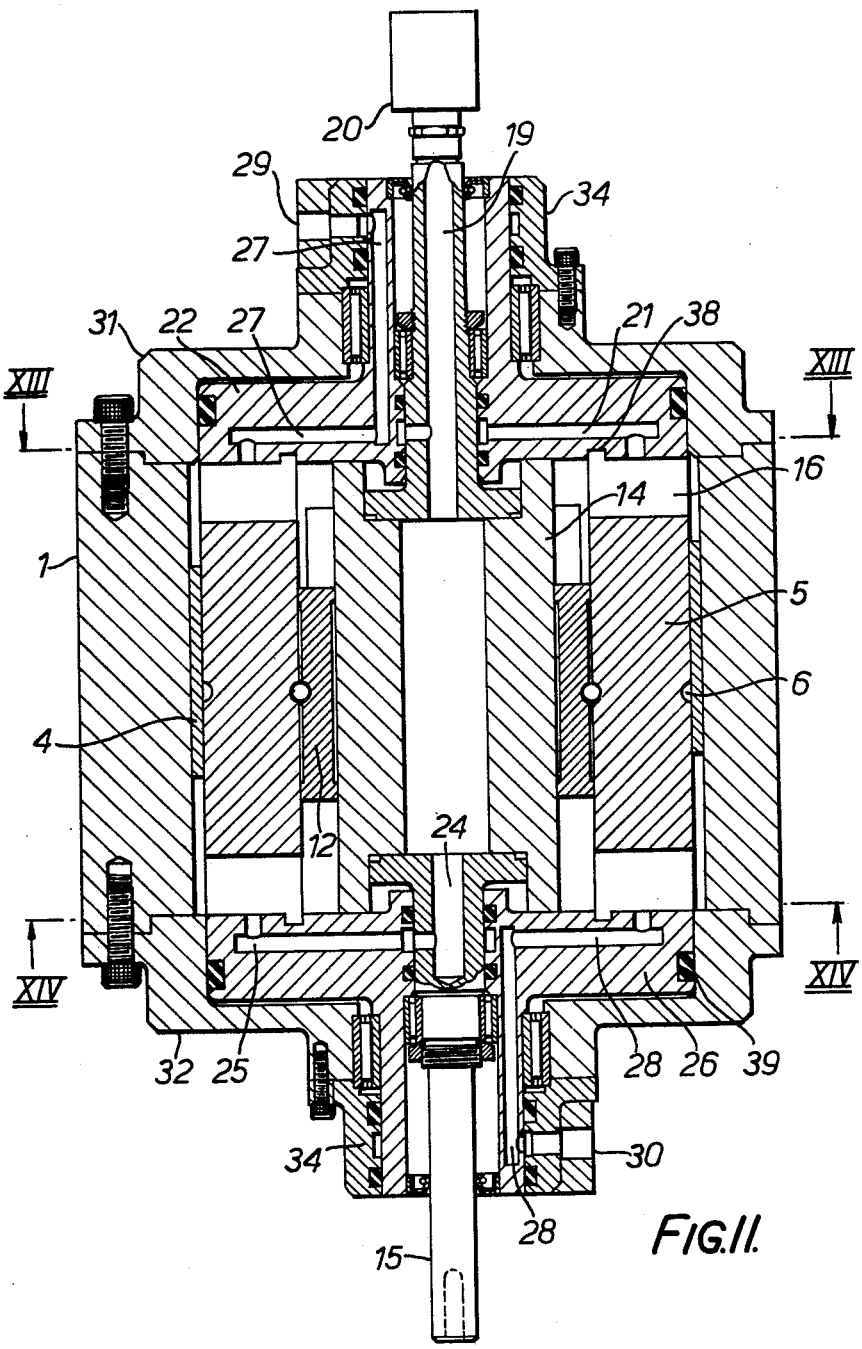
Figure 13:
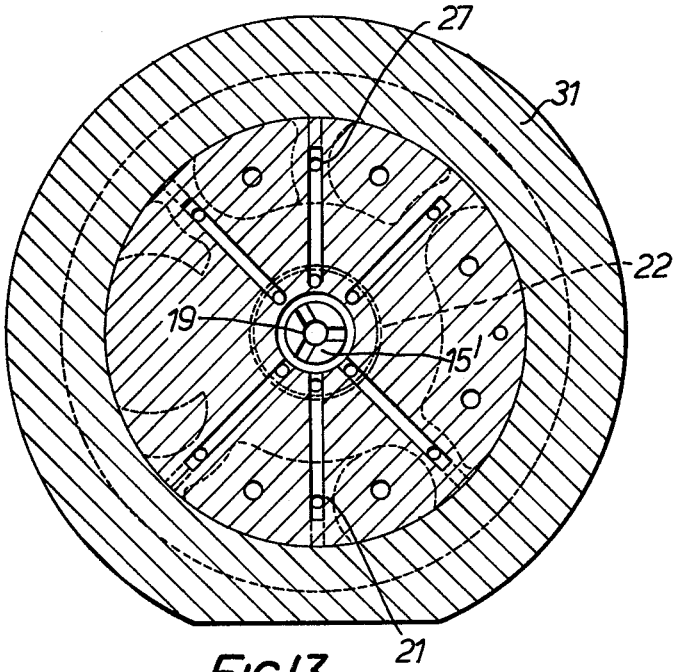
Figure 14:
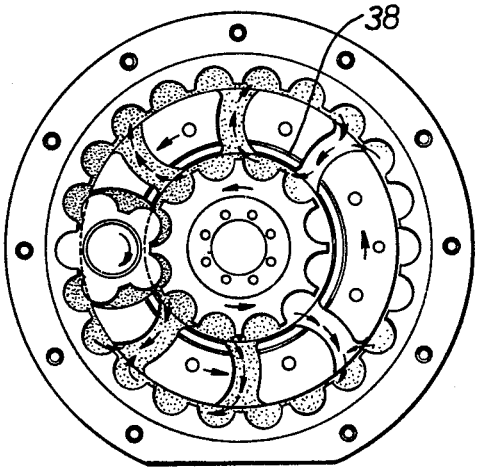
Figure 15:
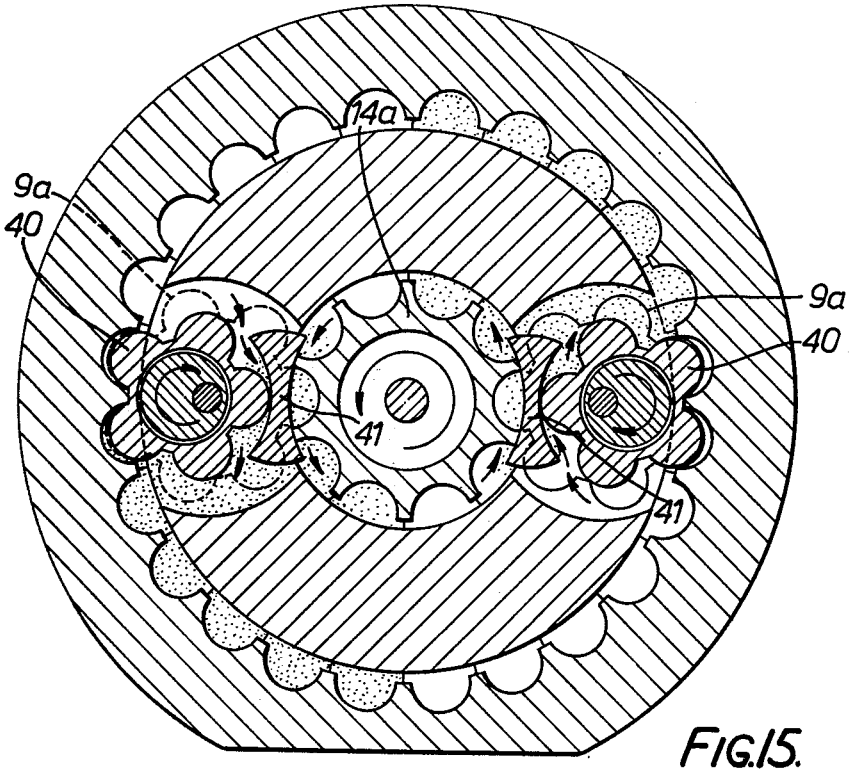
Figure 16:
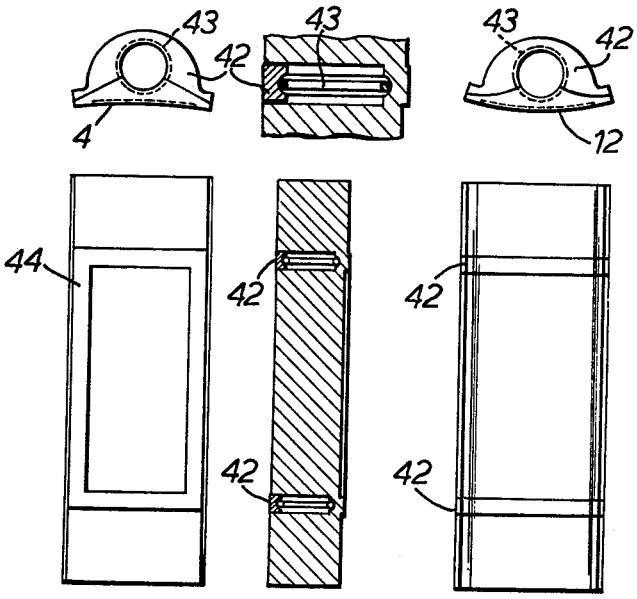

For a better understanding of the invention, some constructional forms will now be described, by way of example, with reference to the accompanying drawings, in which:

FIG. 1 is a diagrammatic cranked cross-section through a machine according to the invention, FIG. 2 is a perspective view of any array of pistons as they are disposed in the machine, FIG. 3 is a perspective view of a core member with cam tracks forming part of the machine, FIG. 4 is a development diagrammatically illustrating the cooperation of pistons and cam tracks, FIG. 5 is a force diagram, FIG. 6 is a perspective view, partly cut away, of the machine of FIG. 1, and shown with a cylindrical outer body, FIG. 7 is a cranked cross-section through another machine according to the invention, FIG. 8 is a cranked cross-section through a practical form of the machine of FIG. 1, FIG. 9 is a plane cross-section through the machine of FIG. 8, FIG. 10 is an axial section of the machine of FIG. 8, on the line X—X, FIG. 11 is another axial section of the machine of FIG. 8, at right angles to the sectional plane of FIG. 10, on the line XI—XI, FIGS. 12A and 12B are developments diagrammatically showing the cooperation of the pistons with the cam tracks, FIG. 13 is a section on the line XIII—XIII of FIGS. 10 and 11, FIG. 14 is a section, to a reduced scale, on the line XIV—XIV of FIGS. 10 and 11, FIG. 15 is a cranked cross-section through a modified machine, and FIG. 16 illustrates various sealing arrangements.

The machine of FIGS. 1 and 6 has a fixed outer body 1 in which there is a generally cylindrical chamber 2 with evenly spaced substantially semi-cylindrical recesses 3 providing the effect of an internally toothed wheel. Pistons 4 are slidable in these recesses, and in cross-section they are corespondingly semi-circular with flanges that project circumferentially so that adjacent pistons touch centrally of the lands between recesses.

Closely fitting within this closed loop of pistons there is a co-axial, generally cylindrical, core 5 as best seen in FIG. 3. It has undulating circumferential cam tracks 6 and 7 formed in its outer and inner cylindrical surfaces respectively and it is also cut away at diametrically and axially opposed regions 8 to accomodate gates 9 in the form of spur gears which axially fill the cut-outs 8 and mesh closely with the recesses 3. The pistons 4 are of uniform height exactly equal to the axial length of the core remaining at the cut-outs 8; and they are entrained by ball bearings 10 to be guided by the cam track 6 under one of the gates 9 and over the other. The gates 9 are rotationally carried by the core on pins 11 projecting centrally into the respective cut-outs 8.

A corresponding array of pistons 12 cooperate with the inside of the core and are guided through ball bearings 10 in cam track 7. FIG. 2 shows this array of pistons. They slidingly fit semi-cylindrical recesses 13 evenly spaced around a rotor 14 mounted on shaft 15. This rotor also meshes with the gates $\theta$, which divide the space within the member 1 into four separate chambers, assuming there to be end closure members (not shown). These chambers may be described as being of curved triangular shape, more easily appreciated from the development of FIG. 4, and each is divided, but not completely, by part of the core 5. Two of the compartments which are diametrically and axially opposed are initially pressurised (P) and the other two are left unpressurised (N).

The arrangement is such that the pistons on one leg of each of the undulating cam tracks are urged downwardly, and those on the other leg are urged upwardly. The resulting pressure may be shown from FIGS. 4 and 5 to urge the core, gates and rotor in the directions indicated in FIG. 1. In this case the cam tracks are descending from the 7 o'clock to the 11 o'clock position and ascending from the 1 o'clock to the 5 o'clock position, and the pistons are passing below the gate uppermost in the drawing and above the other gate. The stippling indicates the zones where the depth of the pressure chambers is largest.

FIG. 7 is a modification of the machine described above in that instead of semi-cylindrical recesses in the fixed body and rotor there are semi-cylindrical lobes, and the gates and pistons are recessed correspondingly. Corresponding parts are referenced as before, with primes.

FIGS. 8 to 14 show a practical embodiment of the machine of FIG. 1. FIGS. 8 and 9 differ little from FIG. 1 and are correspondingly referenced, but it will be noted that there are vents 16 in the core which ensure that there is free flow of fluid within each chamber between opposite sides of the core. The body 1 is non-circular with a flat 17 for mounting.

Referring to FIGS. 10 and 11, the inner rotor 14 is fixed by socket cap screws 18 and sealed by O-rings to shafts $15_1$ and $15_2$ at each end. The input shaft $15_1$ has a central bore 19 to provide ducting for passage of fluid into the machine via a rotary union 20. This will connect to a stationary pipe. From the bore 19 the fluid can pass to one pressure chamber via radial ducts 21 in upper end closure member 22 and freely through a central passage 23 of the rotor into a further short bore 24 in the output shaft $15_2$. It can then distribute to the opposite pressure chamber through further radial ducts 25 within low end closure member 26. The unpressurised chambers vent via radial and axially parallel ducts 27 and 28 in the respective closure members 22 and 26 and thence to outlets 29 and 30.

The outer body 1 is closed at each end by annular flanges 31, 32 with central bosses to receive bearings 33 in which the core 5 rotates by means of the members 22 and 26. The bearings are concealed by caps 34. The rotor 14 runs in bearings 35 within axial extensions of the members 22 and 26, and the gates 9 rotate on pins 11 through bearings 36. Dowel pins 37 and an annular rib and groove arrangement 38 at each end of the core 5 locate the latter with respect to members 22 and 26, and various seals are indicated by 39.

FIG. 10 is a cross section showing the gates 9 and the inner and outer pistons 12,4 passing under and over them. FIG. 11 is the transverse cross section and shows the piston half way up and down the respective cam tracks. FIGS. 12A and 12B are diagrammatic developments showing the relationship of the pistons to the cam tracks, gates and vents. The section of FIG. 14 illustrates the various rotational relationships and the flow paths of the fluid for that cross section. The stippled shading indicates the depth of the chambers, increasing to the darker areas.

These machines can be operated by compressed air or liquid. Although it has some advantages, compressed air does require provision being made for lubrication, and therefore it is preferred to employ pressurised oil as the fluid medium.

There will inevitably be losses from such a machine and provision can be made for making up for this. An example is shown in FIG. 15, where the gates 9*a* are only partially in their original form. They are each axially extended by a smaller gear wheel 40 radially offset to mesh in the same way with the outer teeth. However, these gear wheels are shielded from the inner rotor 14*a* by baffles 41 carried by the core. These prevent fluid returning to the unpressurised chambers and as the gears revolve (in the same direction as the gates) fluid will be forced into the pressure chambers, which are again indicated by stippling. The inner rotor also revolves in the same direction and will likewise transport fluid, as indicated by arrows. The gears 40 must comprise five teeth at the minimum and this necessitates the gates having seven teeth and correspondingly alters the number of recesses in the body and rotor.

FIG. 16 illustrates various sealing arrangements for the pistons. Although it might be possible to operate without them it is preferred. Instead of those shown in FIG. 16 metal or ceramic hydrostatic seals may be used, particularly with high pressures. In the figure, seals 42 are recessed into the pistons 4 and 12 and are urged outwardly to co-operate with their respective recesses by spring means 43. They are indicated in outline in FIG. 12. The opposed face which co-operates with the core 5 is formed with a raised rectangular nib 44 which reduces the surface-to-surface contact, and preferably it is plasma sprayed with a low-friction material or made of metal with a low coefficient of friction.

I claim:

1. A machine for generating motion comprising a mutually rotatable co-axial assembly of an internally toothed outer member, a generally cylindrical intermediate core and an externally toothed inner member; an even number of circumferentially evenly spaced toothed gate elements rotationally carried by said core at alternately opposite axial ends, these gate elements meshing with said members; closure means at each axial end of said assembly to seal off the space between inner and outer members and each to sealingly co-operate with one end face of the respective one or group of said gate elements; two arrays of pistons respectively axially slidable along the teeth of the inner and outer members and which co-operate with the inner and outer faces of the core; guide means on said core faces determining paths for both arrays of pistons that direct them with a close sliding fit between the other end faces of the gate elements and the closure means remote therefrom, said space thus being divided by said pistons and said gate elements into double said number of similar mutually separate chambers of generally curved triangular shape; and means providing fluid passages to and from said chambers.

2. A machine as claimed in claim 1, wherein there are two diametrically and axially opposed gate elements.

3. A machine as claimed in claim 1 wherein the outer member is fixed.

4. A machine as claimed in claim 1, wherein the teeth in said inner and outer members are formed by lands between substantially semi-cylindrical recesses.

5. A machine as claimed in claim 1, wherein the teeth in said inner and outer members are formed by substantially semi-cylindrical lobes.

6. A machine as claimed in claim 1, wherein the guide means comprise tracks recessed into the inner and outer faces of the core, the pistons each being provided with a projection that locates in the adjacent track.

7. A machine as claimed in claim 1, wherein the gate elements are modified by the substitution, for part of their length, of offset gear elements which mesh with one of said members and which are shielded from the other by a baffle which is fixed to the core, the arrangement being such that there is gear pumping between circumferentially adjacent chambers.

8. A machine as claimed in claim 1, wherein the core parts of which circumferentially divide each chamber into radially inner and outer sub-chambers, is cutaway or reduced over said parts to allow free circulation of fluid between said sub-chambers.

9. A machine as claimed in claim 1, wherein said fluid passages are through said inner member and said end closure means.

* * * * *